United States Patent [19]

Abrams

[11] 4,069,769

[45] Jan. 24, 1978

[54] TABLE STRUCTURE

[76] Inventor: Marilyn M. Abrams, 3440 Beret Lane, Silver Spring, Md. 20906

[21] Appl. No.: 711,225

[22] Filed: Aug. 3, 1976

Related U.S. Application Data

[63] Continuation-in-part of Ser. No. 593,215, July 7, 1975, abandoned.

[51] Int. Cl.[2] ..... A47B 7/02

[52] U.S. Cl. ..... 108/11; 108/33; 108/62; 108/91

[58] Field of Search ..... 108/11–13, 108/25, 33, 62, 91, 96; 297/440, 442

[56] References Cited

U.S. PATENT DOCUMENTS

| | | | |
|---|---|---|---|
| 549,869 | 11/1895 | Dryfoos | 108/96 |
| 606,928 | 7/1898 | Lamb | 108/62 |
| 735,312 | 8/1903 | Stokes | 108/96 |
| 996,354 | 6/1911 | Logsdon | 108/96 |
| 3,289,616 | 12/1966 | Donihi | 108/25 |

*Primary Examiner*—Roy D. Frazier
*Assistant Examiner*—Darrell Marquette

[57] ABSTRACT

A coffee table having an upper surface comprised of a main portion which is part of the coffee table structure and the side skirts of a pair of auxiliary foldable tables which are stored, in their folded configuration, in slots in the main table. The dimensions and external fold configuration of the foldable tables are such that, when they are stored in the slotted openings, they combine with the surface of the coffee table to form a continuous top planar surface. The interiors of the two slotted openings are finished, and the coffee table has sufficient top surface to still be usable as a table when both foldable tables are removed. Also, the coffee table has a finished bottom surface, and so it can be inverted when the foldable tables are removed to present an unbroken top surface.

17 Claims, 5 Drawing Figures

TABLE STRUCTURE

RELATED APPLICATION

This application is a continuation-in-part of copending application serial number 593,215 filed July 7, 1975, abandoned.

BACKGROUND OF THE INVENTION

This invention relates generally to table systems, and more particularly to a decorative and functional main table having a plurality of foldable tables stored therein.

It has become commonplace to utilize small, foldable "snack" or "TV" tables in living rooms, family rooms and the like. There are many types of such foldable tables, and many systems, racks and furniture pieces designed to store them in their folded condition. Chiefly, these systems, racks and furniture pieces fall into two categories. First, there are tables that, when the legs are folded, are fitted onto or into a frame or rack, which is equipped with a handle or wheels, or both, so it can be moved. While such an arrangement is functional, the rack alone, or the rack with tables installed, is not usable or attractive. Because of this, it is relegated to an obscure portion of the room, or is stored in a closet or in another room. In the former case, the items take up usable space in the room, and are an eyesore, and in the latter case the tables are not close at hand for immediate use. The second category is one of furniture pieces in which folded tables are stored. These are chests or the like, having doors which open to reveal the folding table storage compartment. They offer the disadvantage of being a relatively large, otherwise substantially unusable piece, which must be fitted into the decor of the room. Their utility is so limited that they must generally be considered rather a waste of space, other than for their use for storing the folding tables. The significance of the shortcomings of the prior art devices is accentuated when the room or living quarters involved is small, since the presence of an extra piece of furniture under those circumstances lowers the efficiency of the room, and complicates the furnishing of the room.

SUMMARY OF THE INVENTION

This invention provides a piece of furniture that is decorative and useful at all times, and which provides storage for a plurality of foldable tables.

The invention comprises a main table and a plurality of foldable auxiliary tables. The main table is most advantageoulsy of a height, width and length that renders is primarily useful as a coffee table, or an end table. The main table has an upper planar surface having one or more slotted openings sized to receive a foldable table in the folded configuration. The slotted openings can be at the ends of the main table top or at an intermediate point therein. Each slotted opening is at least in part in the top of the main table, and can extend the full width of the table. The slotted openings preferably do not encompass a major portion of the top surface of the main table so that, when all foldable tables are removed, sufficient top surface remains to enable the main table still to be usable. Likewise, the spacing between slotted openings, if intermediately positioned, from one another and/or from the ends of the table is so planned as to further this aim. The bottom surface of the main table is preferably a finished complete planar surface, which can be exposed for use as a table top if the main table is inverted.

Each foldable table comprises a table top and a skirt around all four sides. The skirt is of the same width as the width of the slotted openings in the main table. The size and configuration of the foldable table top is such that, when the foldable table is in its storage slot, its skirt along one side is flush with the adjacent main table top to provide a substantially unbroken planar surface. Preferable, in such position, the skirt on two opposite sides will conform to the configuration of the sides of the main table. The legs of each foldable table fold within the envelope of the table top and skirt.

This invention overcomes the deficiencies of the prior art, for it provides a table useful at all times as a coffee table, end table, or the like, while providing storage for foldable tables right at hand. It also provides an interesting piece, whether the foldable tables are installed or removed.

DESCRIPTION OF A PREFERRED EMBODIMENT

This invention comprises in its first embodiment a main table indicated generally as 10 and a plurality of foldable auxiliry tables, each designated as 12. For simplicity in appreciating this invention, the external configuration in which it is illustrated is a quadratic. However, the invention is conceptually not so limited. Likewise, while two foldable tables are illustrated, this also is not to be considered a limiting factor.

Figure 1:
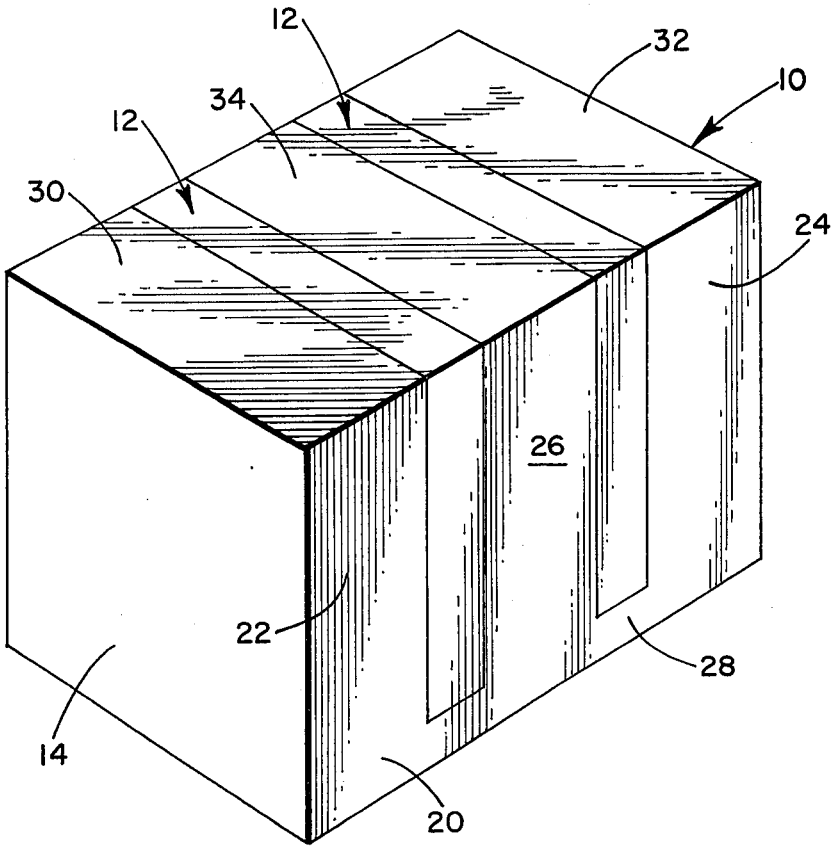
FIG. 1 is a perspective view of the invention with the foldable tables in their storage position in the slotted openings intermediately positioned in the main table.
Figure 4:
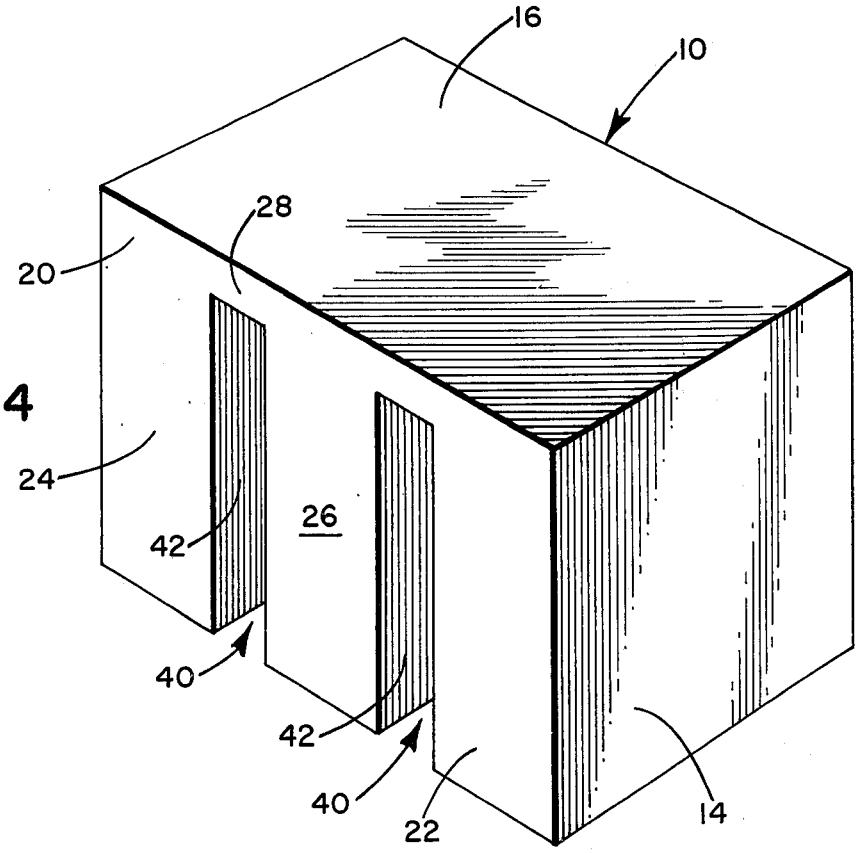
FIG. 4 is a perspective view of the main table in an inverted position with the foldable tables removed.
Figure 2:
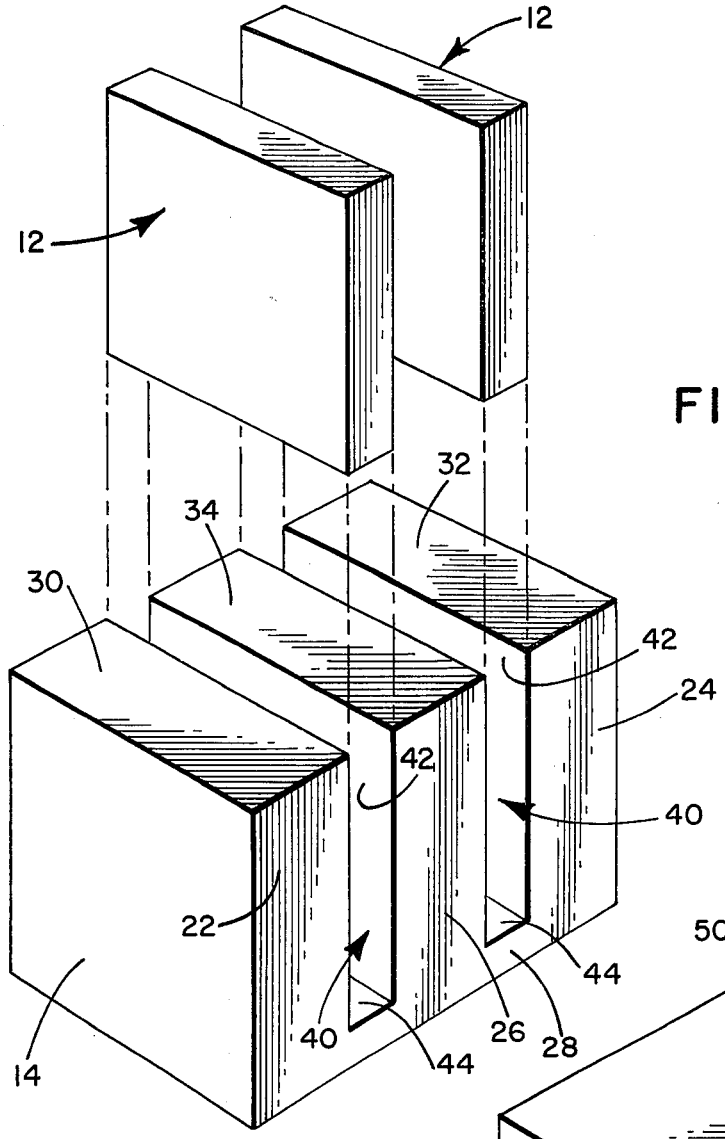
FIG. 2 is an exploded view of the invention of FIG. 1.
Figure 3:
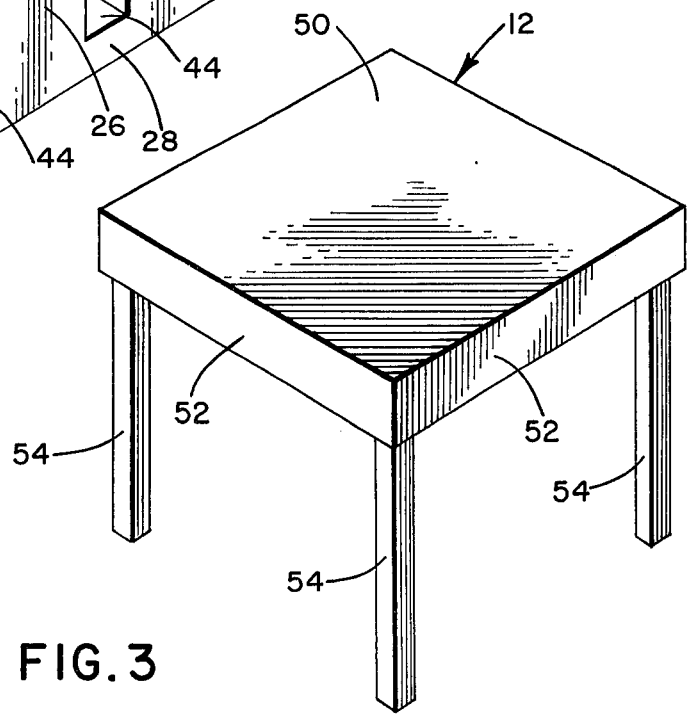
FIG. 3 is a perspective view of one of the foldable tables with its legs extended.

Main table 10 has end faces 14 and a bottom surface 16. End face 14 and bottom surface 16 are suitably finished in an attractive manner. Bottom surface 16 can function also as a table top, if main table 10 is inverted, as shown in FIG. 4.

Main table 10 also has a pair of side faces 20, each of which comprises side end portions 22 and 24, side central portion 26, and side base portion 28. The top surface of main table 10 comprises top end portions 30 and 32, and top side portions 34.

A pair of slotted openings 40 extend through main table 10, opening at both sides and at the top. Each opening 40 is defined by a pair of opposed slot side surfaces 42, and by a slot bottom surface 44. All of these surfaces are attractively finished, since they are sometimes exposed to view. As illustrated herein, each slot side surface 42 is of square configuration, the slot depth being equal to the width of main table 10. This allows for the use of a foldable table having a top surface of square configuration, which has the advantage of allowing any portion of the auxiliary table to be oriented upwardly when installed in the slots. While the dimensions of main table top surface portion 30, 32 and 34 are shown as being substantially identical, this can be varied. For example, slots 40 could be located closer to one another, thus enlarging top surface portions 30 and 32, ad diminishing portion 34. It should be reaized that the slotted openings 40 need not extend entirely across the width of the table surface, in which case they would be open only at the top and along one side.

Each foldable table 12 comprises a foldable table top 50, a downwardly extending skirt 52, and four foldable legs 54. The size and shape of table top 50 is identical to that of the slot side surface 42, so that when each table 12 is installed in its slot 40, side skirt 52 is in the same plane as the side and top surfaces of the main table. This is especially important in the case of top surface 50, so that a smooth planar surface is created when the foldable tables are in place. The height of side skirt 52 is substantially identical to the width of slot bottom surface 44, so that skirt 52 completely fills the width of slots 40. Legs 54 are foldable inwardly to be hidden within the envelope of side skirt 52. The folding mechanism (not shown) can be any of a number of conventional types. Also, the legs could be other than the straight corner type shown, but could be telescoping, crossed, or other types.

The operation of the invention should be apparent from the drawings. Foldable tables 12 are stored until needed in slots 40. In such condition, a flush top surface is provided on main table 10, consisting of surface portions 30, 32 and 34 and side skirt 52. This enables the invention to be used as a conventional coffee or end table. If necessary, one or both foldable tables 12 can be removed and unfolded for use separately of main table 10. In such case, main table 10 still has a usable top surface comprising at least the three portions 30, 32 and 34, albeit broken by openings 40. If an unbroken top surface is desired, main table 10 can be inverted, exposing what is usually bottom surface 16.

Many variations on the general theme of the invention are possible. Of course, the particular configurations shown can be varied. However, if foldable table surfaces 50 are square, it matters not how the table is inserted into slot 40. While the top surface and the bottom surface of the main table should be planar, its cross-sectional shape can be varied from the end and from the sides. The surfaces 42 and 44 can be suitably upholstered, and discrete devices (not shown) can be provided within slots 40 to inhibit movement of foldable tables 12 therein. However, a close fit between foldable tables 12 and slots 40 is desirable.

Figure 5:
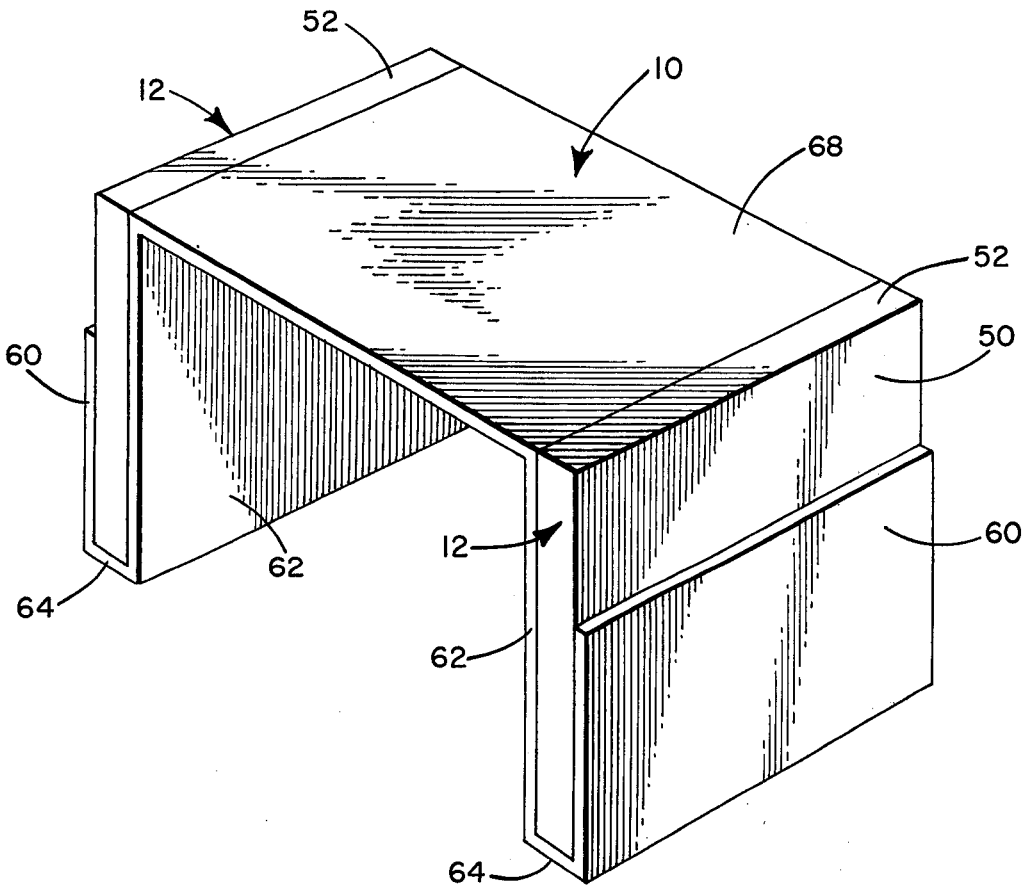
FIG. 5 is a perspective view of the embodiment of the invention wherein the slotted openings are at the ends of the main table.

In the embodiment shown in FIG. 5, the slotted openings appear at the two ends of main table 10. The two foldable tables 12 are identical to those described above. They are positioned in slotted openings defined by an outer side member 60 which is connected to an inner side member 62 by a base member 64. While outer side member 60 is shown terminating short of the full height of table 10, it could extend upwardly to that height. In the alternative, it could be lower, or other means could be provided to support the auxiliary table in its storage position. Tables 12 are stored in the slotted openings with their tops 50 facing outwardly, for best appearance. As in the first embodiment, the side skirt 52 is flush with the main table top 68. The number of slotted openings can be increased, as can the width, to accommodate more than one auxiliary table. In the embodiment, the main table is shown as an open design, not the invertable one described as the first embodiment.

The possibilities are virtually endless to manufacture this invention from materials and colors which are pleasing to the eye. The invention may be manufactured of wood, plastic, or combinations, including such materials as plexiglass, in colored or grain finishes. So, not only is the invention of great utility, it can also become a focal point in the decoration of a room. It's uniqueness adds to its attractiveness.

While modifications and variations of the embodiment described above may well come to the minds of those skilled in the art upon a reading of this disclosure, it should be noted that the breadth of the invention is governed only by the scope of the appended claims.

I claim:

1. A table structure comprising:

a main table having a substantially planar main table top surface broken by at last one slotted opening having a slot width and a slot length measured in the plane of said main table top surface, an auxiliary table having an auxiliary table top surface, a skirt extending from said auxiliary table top surface and having a substantially planar first skirt surface extending outwardly at an angle to said auxiliary table top surface along at least a portion of the perimeter of said auxiliary table top surface for a distanc substantially equal to said slot width, and retractable leg means attached to said auxiliary table, said leg means being movable between an extended position for supporting said auxiliary table and a storage position within an envelope defined by said auxiliary table top surface and said skirt, and means for removably supporting said auxiliary table in said slotted opening with said first skirt surface substantially in alignment with said main table top surface when said leg means are in said storage position.

2. The table structure of claim 1 wherein said means for supporting said auxiliary table comprises a bottom in said slotted opening spaced from said main table top surface and defining a slot depth, and a pair of opposed spaced sides in said slotted opening defining said slot width and extending from said main table top surface to said bottom.

3. The table structure of claim 1 wherein said main table further comprises a main table first side surface, said slotted opening extending through at least a portion of said main table first side surface, and wherein said skirt further comprises a second skirt surface alignable with said main table first side surface when said auxiliary table is installed in said slotted opening.

4. The table structure of claim 1 wherein said slotted openings comprise less than one fourth of the total area of said main table top surface.

5. The table structure of claim 1 wherein said main table further comprises an unbroken planar main table bottom surface, whereby said main table can be inverted to expose said main table bottom surface.

6. A table structure comprising:

a main table having a substantially planar main table top surface and a main table first side surface intersecting said main table top surface, a slotted opening extending across at least a portion of said main table top surface and across at least a portion of said main table first side surface, said slotted opening having a slot bottom surface spaced from said main table top surface and defining a slot depth and a pair of opposed spaced slot side surfaces extending from said main table top surface to said slot bottom surface and defining a slot length measured across said table and a slot width measured perpendicularly thereto.

an auxiliary table having an auxiliary table top surface, skirt means extending downwardly from said auxiliary table top surface at an angle to said auxiliary table top surface for at least a portion of the periphery thereof, first and second skirt surfaces on said skirt means, said first skirt surface being a substantially planar surface extending outwardly from said auxiliary table top surface a distance substantially equal to said slot width at corresponding points along said slot length, said second skirt surface having a cross-section configuration like the cross-sectional configuration of said main table first side surface and intersecting said first skirt surface at an angle equal to the angle at which said main table side surface intersects said main table top surface, said second skirt surface extending outwardly from said auxiliary table top surface a distance substantially equal to said slot width at corresponding points along said slot depth, retractable leg means installed on said auxiliary table, said leg means being movable between an extended position for supporting said auxiliary table and a storage position disposed within an envelope defined by said auxiliary table top surface and said first and second skirt surfaces, the dimension of said auxiliary table measured perpendicularly to said first skirt surface being substantially equal to said slot depth at corresponding points, the dimension of said auxiliary table measured parallel to said first skirt surface being no greater than said slot length at corresponding points whereby when said auxiliary table is installed in said slotted opening resting on said bottom surface thereof said first skirt surface is substantially in alignment with said main table top surface and said second skirt surface is alignable with said main table first side surface.

7. The table structure of claim 6 wherein said main table comprises a main table second side surface in opposed relationship to said main table first side surface and intersecting said main table top surface, wherein said slotted opening extends completely across said main table top surface and through at least a portion of said main table second side surface, wherein said skirt means further comprises a third skirt surface in opposed relationship to said second skirt surface and so configured and dimensioned as to be alignable with said main table second side surface, said third skirt surface extending outwardly from said auxiliary table top surface a distance substantially equal to said slot width at corresponding points along said slot depth, and wherein the distance between opposite points on said second and third skirt surfaces is equal to said slot length at a corresponding point along said slot depth, whereby said auxiliary table substantially completely fills said slotted opening when installed therein.

8. The table structure of claim 7 wherein said slotted opening extends perpendicularly to the center axis of said main table.

9. The table structure of claim 8 wherein said main table top surface is of rectangular configuration, said main table side surfaces are of rectangular configuration and are perpendicular to said main table top surface, said auxiliary table top surface is of rectangular configuration, and said skirt surfaces are of rectangular configuration and are perpendicular to said auxiliary table top surface.

10. A table structure of claim 9 wherein said slot length and said slot depth are of equal dimension, and wherein said skirt means further comprises a fourth skirt surface in opposed relationship to said first skirt surface and parallel thereto, said fourth skirt surface extending outwardly from said auxiliary table top surface a distance substantially equal to said slot width at corresponding points along said slot depth, whereby said auxiliary table top surface is square, and said auxiliary table can be installed in said slotted opening with any one of said skirt surfaces substantially coplanar with said main table top surface.

11. The table structure of claim 10 comprising a plurality of said slotted openings and a plurality of said auxiliary tables, and wherein said slotted openings comprise less than fifty percent of the total area of said main table top surface.

12. The table structure of claim 11 further comprising a main table bottom planar surface spaced from and parallel to said main table top surface.

13. A table structure comprising:

a main table and at least one auxiliary table, said main table having a substantially planar main table top surface supported by leg members, said auxiliary table having an auxiliary table top surface, a skirt extending from said auxiliary table top surface and having a substantially planar first skirt surface extending outwardly at an angle to said auxiliary table top surface along at least a portion of the perimeter of said auxiliary table top surface, and retractable leg means attached to said auxiliary table, said leg means being movable between an extended position for supporting said auxiliary table and a storage position within an envelope defined by said auxiliary table top surface and said skirt, and means on said main table for removably supporting said auxiliary table in such a position as to locate said first skirt surface substantially in alignment with said main table top surface and adjacent thereto when said leg means are in said storage position, whereby a composite table top surface is formed by said main table top surface and said first skirt surface of said auxiliary table.

14. The table structure of claim 13 wherein said means for supporting said auxiliary table comprises a slotted opening having a bottom spaced from said main table top surface and defining a slot depth and a pair of opposed spaced sides in said slotted opening, at least one of said sides extending from said main table top surface to said bottom.

15. The table structure of claim 13 wherein said main table further comprises a main table first side surface, and wherein said skirt further comprises a second skirt surface alignable with said main table first side surface when said auxiliary table is supported by said support means.

16. The table structure of claim 15 wherein said main table comprises a main table second side surface in opposed relationship to said main table first side surface and intersecting said main table top surface, and wherein said skirt means further comprises a third skirt surface in opposed relationship to said second skirt surface and so configured and dimensioned as to be alignable with said main table second side surface when said auxiliary table is supported by said support means.

17. A table structure comprising:

a main table having a substantially planar main table top surface supported by main leg means, at least one auxiliary table having an auxiliary table top surface and a skirt extending from said auxiliary table top surface, said skirt having a substantially planar first skirt surface extending outwardly at an angle to said auxiliary table top surface along at least a portion of the perimeter of said auxiliary table top surface, said auxiliary table having leg means movable between an extended position for supporting said auxiliary table and a storage position, means on said main table for removably supporting said auxiliary table in such a position as to locate said first skirt surface substantially in alignment with said main table top surface and adjacent thereto when said leg means are in said storage position, whereby a composite table top surface is formed by said main table top surface and said first skirt surface of said auxiliary table.

* * * * *